US005729089A

United States Patent [19]

Zhu et al.

[11] Patent Number: 5,729,089

[45] Date of Patent: Mar. 17, 1998

[54] ELECTRODE ASSEMBLY FOR HIGH PRESSURE SODIUM LAMP AND METHOD OF MAKING SAME

[75] Inventors: Huiling Zhu, Londonderry; Paul H. Ingalls, Penacook; Robert B. Dolan, Manchester, all of N.H.

[73] Assignee: Osram Sylvania Inc., Danvers, Mass.

[21] Appl. No.: 649,378

[22] Filed: May 17, 1996

[51] Int. Cl.[6] ..... H01J 61/36

[52] U.S. Cl. ..... 313/623; 313/631; 313/326; 313/574

[58] Field of Search ..... 313/623, 625, 313/624, 631, 283, 284, 292, 331, 632, 332, 565, 326, 574

[56] References Cited

U.S. PATENT DOCUMENTS

| | | | |
|---|---|---|---|
| 3,986,236 | 10/1976 | Barakitis | 29/25.15 |
| 4,052,635 | 10/1977 | Jacobs | 313/623 |
| 4,538,091 | 8/1985 | Lewis et al. | 313/625 |
| 4,559,473 | 12/1985 | McVey | 313/630 |
| 4,804,889 | 2/1989 | Reid et al. | 313/624 |
| 4,937,494 | 6/1990 | Dunn | 313/623 |
| 4,959,588 | 9/1990 | Vida et al. | 313/623 X |
| 5,026,311 | 6/1991 | White | 445/26 |
| 5,343,117 | 8/1994 | Wyner et al. | 313/623 |
| 5,424,608 | 6/1995 | Juengst et al. | 313/623 |
| 5,569,978 | 10/1996 | Oiye et al. | 313/623 X |

*Primary Examiner*—Ashok Patel
*Attorney, Agent, or Firm*—William H. McNeill

[57] ABSTRACT

Variable backspace in electrode assemblies for high pressure sodium lamps is achieved by employing a hollow electrode base which has one end formed to frictionally engage an electrode, which electrode includes a solid core having a coil about one end thereof. The solid core is inserted into the electrode base a given distance and is maintained in this position by friction until welding is accomplished. The electrode base is provided with a positioning ring which is formed at the time the base is first formed. The electrode assemblies can be utilized with lamps having different arc lengths while using arc tubes having the same size.

4 Claims, 5 Drawing Sheets

ELECTRODE ASSEMBLY FOR HIGH PRESSURE SODIUM LAMP AND METHOD OF MAKING SAME

TECHNICAL FIELD

This invention relates to high pressure discharge lamps and more particularly to high pressure sodium lamps. Still more particularly, it relates to cathodes and cathode assemblies for such sodium lamps and to a method for making such cathodes and cathode assemblies.

BACKGROUND ART

In high pressure sodium (HPS) lamps, the arc tube is made from monocrystalline alumina (sapphire) or polycrystalline alumina (PCA). Gas-fight ceramic-to-metal seals between the discharge tube and a pair of niobium current inleads, which have tungsten cathodes affixed thereto, close the ends of the discharge tube. Niobium (which may include an addition of about 1% zirconium) is used as the inlead material because its coefficient of thermal expansion closely matches that of the alumina arc tube Further, niobium is resistant to sodium at high temperatures and has a relatively high permeability for hydrogen, allowing hydrogen impurities in the are tube to escape therefrom and to be sorbed by a getter in the outer bulb which surrounds the arc tube. The niobium current inlead can take the form of a wire (U.S. Pat. No. 4,538,091) or a tube (U.S. Pat. Nos. 4,559,473; 5,026,311; 5,424,608) on which the tungsten electrodes are fixed, usually by crimping and/or welding or by brazing, usually with titanium.

A critical feature of HPS lamps is the arc length, defined as the interior distance between electrode tips within the arc tube. In order to control the position of electrodes inside an arc tube, a positioning feature is provided on the niobium inleads. This positioning feature can be welded fine wires on the inlead, such as are shown on the above-mentioned U.S. Pat. No. 5,026,311; wire clips attached frictionally, such as shown in U.S. Pat. No. 4,538,091; deformations-formed on the inlead, such as shown in U.S. Pat. Nos. 4,559,473 and 4,937,494; or specially shaped, cooperative apertures formed in the end seals of the arc tubes, such as shown in U.S. Pat. No. 5,424,608. The location of the positioning feature is important in determining the backspace, the backspace being the distance between the upper or lamp side surface of the positioning feature and the top of the cathode coil. This spacing determines the arc length. Whatever feature has been employed in the past, if the inlead is to be useable on multiple lamp types, it has been necessary that it be formed at a different position on the inlead. This operation can increase the cost of manufacturing lamps and can lead to errors in electrode selection.

DISCLOSURE OF INVENTION

It is, therefore, an object of this invention to obviate the disadvantages of the prior art.

It is another object of the invention to enhance HPS lamp cathodes and cathode assemblies.

Yet another object of the invention is the economization of cathode assembly manufacture.

These objects are accomplished, in one aspect of the invention, by providing an electrode base for an electrode for an are discharge lamp. The electrode base comprises a tubular, electrically conductive body having a first end having a first diameter and a second end having second and third diameters, the second and third diameters being smaller than the first diameter and the second diameter being smaller than the third diameter. A positioning is ring formed about an intermediate portion of the first end.

In another aspect of the invention, the objects are accomplished by providing an electrode assembly which comprises an electrode having a rod-shaped, solid core of an electrically conductive material having a coil of electrically conductive material wrapped about one end thereof; and an electrode base as described above. The rod-shaped core has a diameter substantially equal to the second diameter and is frictionally engaged within the second end of the base.

The objects are additionally further achieved by the provision of a method of making a cathode assembly for a discharge lamp, which comprises forming an electrode base which includes a cathode positioning feature; forming a cathode; positioning the electrode base at a work station; frictionally inserting the cathode into the electrode base; adjusting the backspace to a desired dimension; and welding the cathode to the electrode base to form the electrode assembly.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
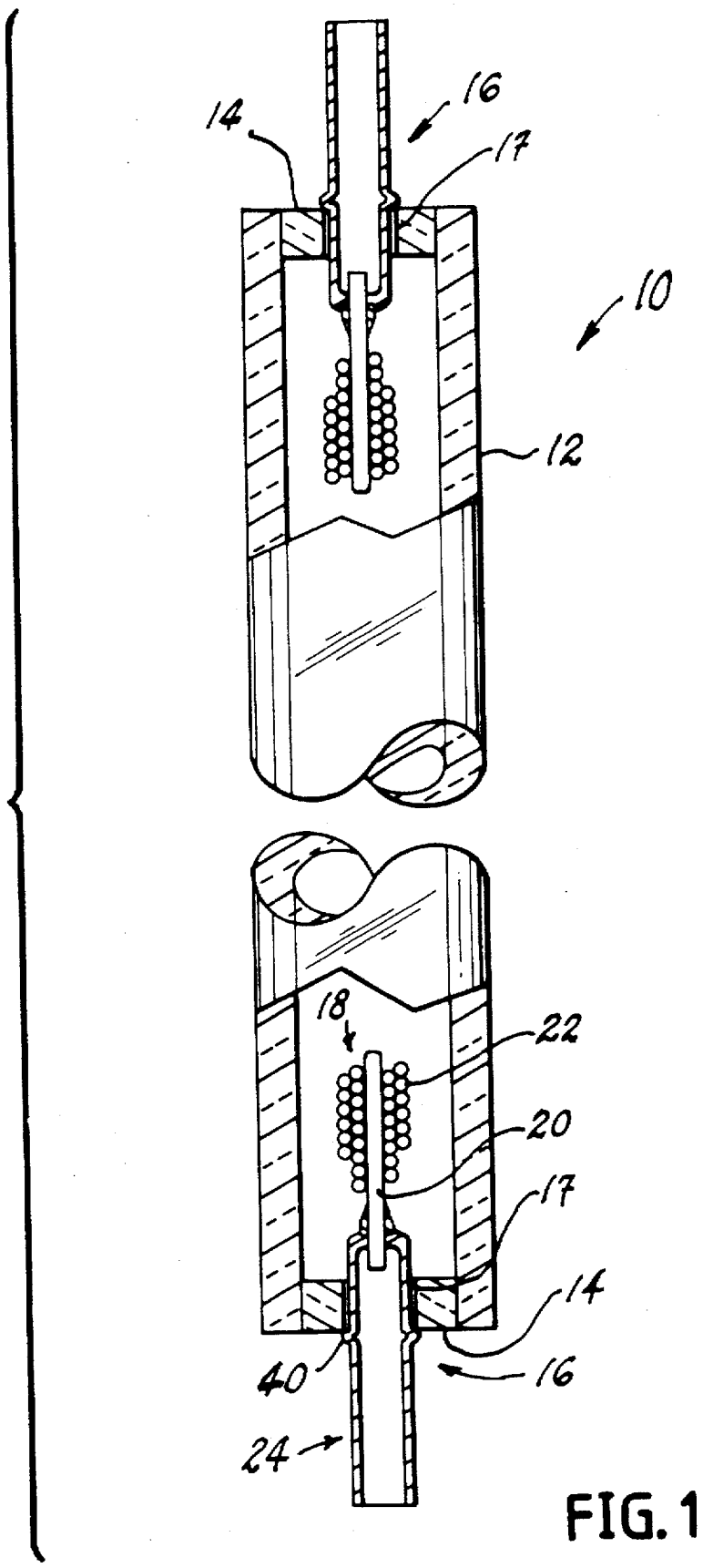
FIG. 1 is an elevational view, partly in section, of an arc discharge light source utilizing an embodiment of the invention.

Referring now to the drawings with greater particularity, there is shown in FIG. 1 an arc tube 10 for a high pressure sodium lamp. Arc tube 10 has a tubular body 12 which is translucent at least to visible radiation and is formed from alumina or yttria. When alumina is employed it is usually of the polycrystalline variety and may included dopants which aid in the control of particle size, as is known in the art. Monocrystalline alumina (i.e., sapphire) can also be used. The arc tube body 12 is sealed at both ends by sealing discs 14, each of which contains an electrode assembly 16 sealed therein. The discs 14 can be sealed into the ends of the body 12 in any suitable manner including, without limitation, pressure fitting by firing the arc tube body with the sealing disc in place and employing controlled shrinkage, or by using a sealing frit. The electrode assembly 16 can be sealed into the disc in the same manner, although the use of a sealing frit is preferred. When a sealing frit is employed, the sealing operation can comprise placing the arc tube body 12 with its sealing disc 14 and an electrode assembly 16 having a frit ring thereabout in a vacuum furnace in a vertical position, the electrode end being downward. The furnace is then evacuated to submicron vacuum and sufficient heat is applied to the assembly to cause the sealing frit to melt and flow: the sealing temperature is about 1400° C. The frit flows completely around the electrode base 24 and into the capillary space 17 between base 24 and disc 14. The capillary space is only a few mils thick. The frit material is of the type commonly used in the sealing of alumina arc tubes for HPS lamps and comprises mainly alumina and alkaline earth oxides, primarily calcia, as is known in the art. See, for example, U.S. Pat. No. 3,986,236. An arc generating and sustaining medium is included within the hermetically sealed arc tube 10 and can include sodium, mercury and an inert gas, as is known. The sodium operating vapor pressure in such lamps is of the order of 50 to 100 torr and light output in excess of 100 lumens per watt is obtainable.

Figure 2:
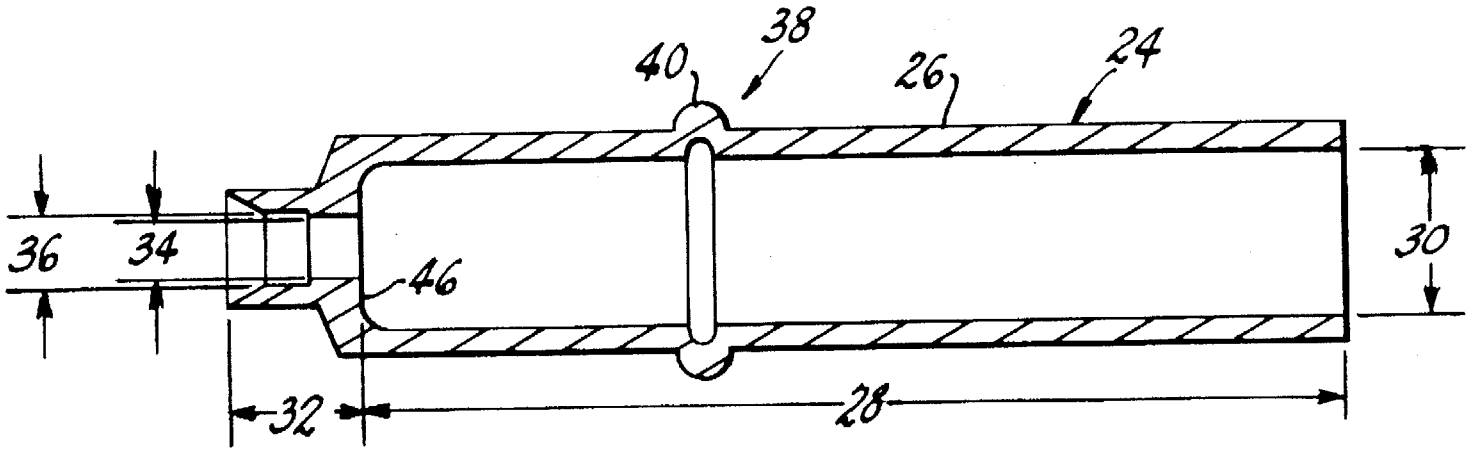
FIG. 2 is an elevational, sectional view of an embodiment of an electrode base.

The electrode assembly 16 comprises an electrode 18 having a rod-shaped, solid core 20 of a suitable electrically conductive material, such as tungsten, a tungsten coil 22 wrapped about and fixed to an end thereof, and an electrode base 24. The electrode base 24 comprises a tubular, electrically conductive body 26 formed of a suitable material having a thermal expansion coefficient compatible with that of the PCA sealing disc 14. Such a material can be niobium and preferably is niobium containing about 1% zirconium. Body 26 (see FIG. 2) has a first end 28 having a first diameter 30 and a second end 32 having second diameter 34 and third diameter 36. The latter two diameters are both smaller than diameter 30 and the second diameter 34 is smaller than the third diameter 36. A positioning feature 38 in the style of ring 40 is positioned about an intermediate portion of first end 28.

Figure 3:
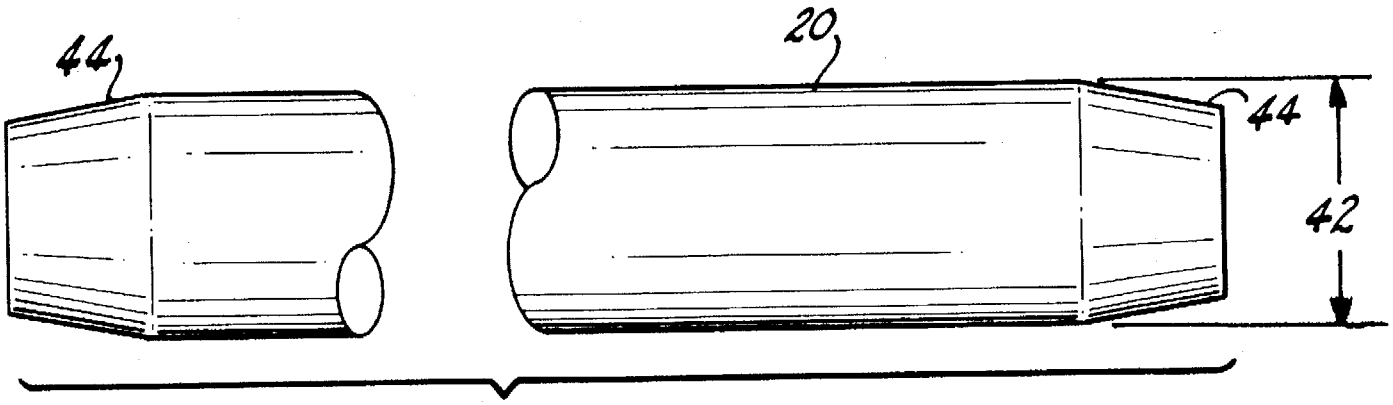
FIG. 3 is an elevational view of a rod-shaped core employed with the invention.
Figure 6:
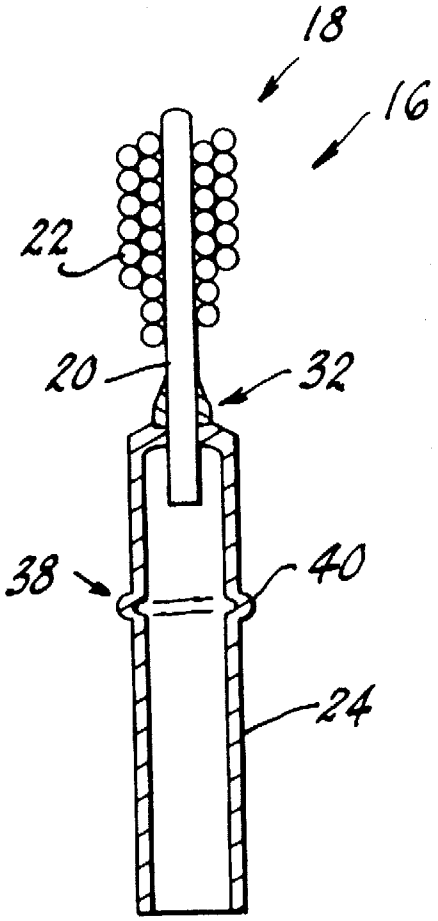
FIGS. 4–6 are elevational, sectional views of steps in the manufacture of an electrode assembly in accordance with an embodiment of the invention.
Figure 5:
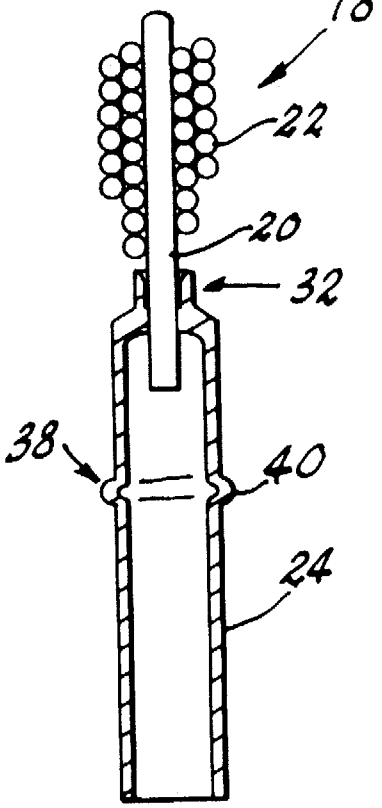
Figure 4:
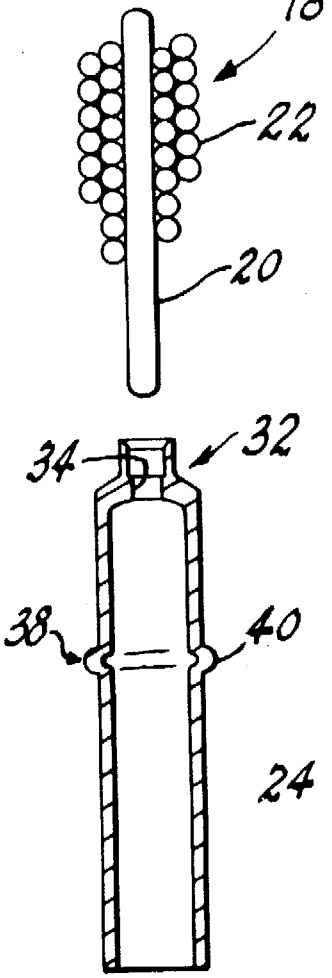

The solid, rod-shaped core 20 has a diameter 42 equal to the second diameter 34 and is provided with ends 44 which can be tapered as shown in FIG. 3 or rounded as shown in FIGS. 4–6 to aid in insertion into the second end 32. Since the diameter 42 of the core 20 matches that of the second diameter 34 a frictional engagement is provided.

The cathode assembly 16 is formed as shown in FIGS. 4–6 wherein an electrode base 24 is positioned at a first work station and a previously formed cathode electrode 18 is inserted into the electrode base 24 to achieve a desired backspace. Initially, the electrode 18 is held in position by the frictional engagement of rod 20 with the walls of the second end 26 defined by the second diameter 34 of the base 24. When the desired backspace is fixed, the electrode 18 is welded to the base 24, preferably by tungsten-inert-gas (TIG) welding, without the addition of any extra material. To insure that the welding operation does not disturb the alignment of the electrode 18 in the base 24, the second end 32 has a transverse wall portion 46 that has a wall thickness that is twice as thick as the wall thickness of the first end 28.

Figure 7:
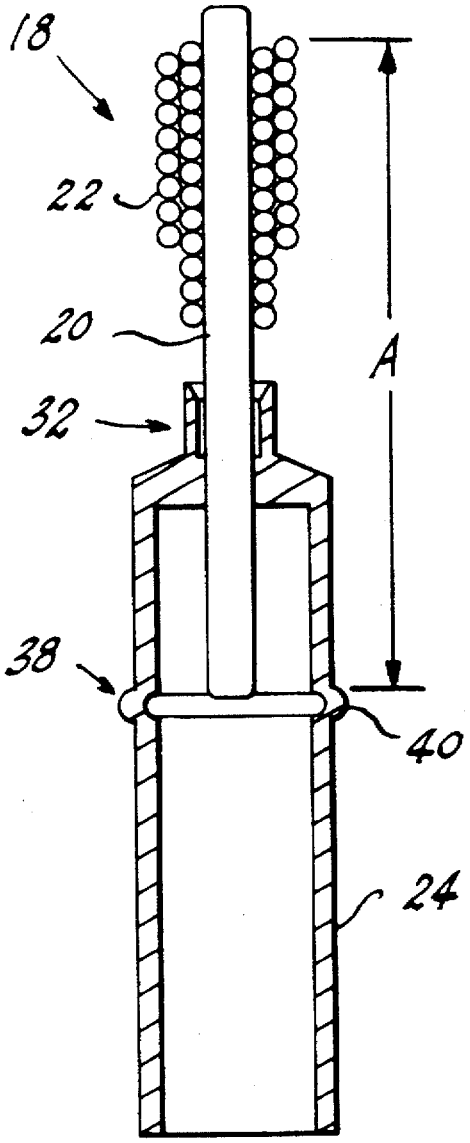
FIGS. 7 and 8 are elevational sectional views illustrating the variability in size that can be accomplished with the invention.
Figure 8:
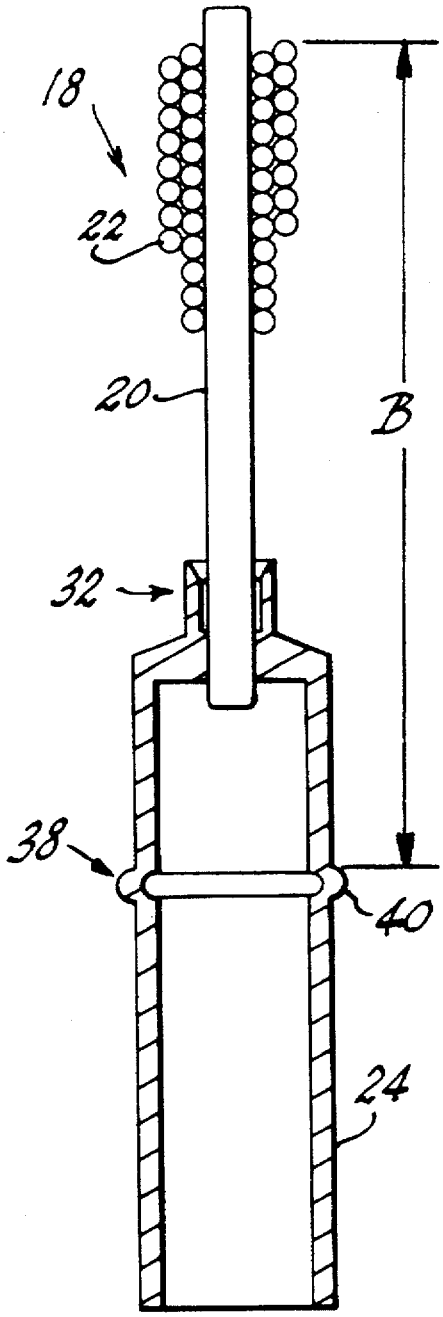
Figure 9:
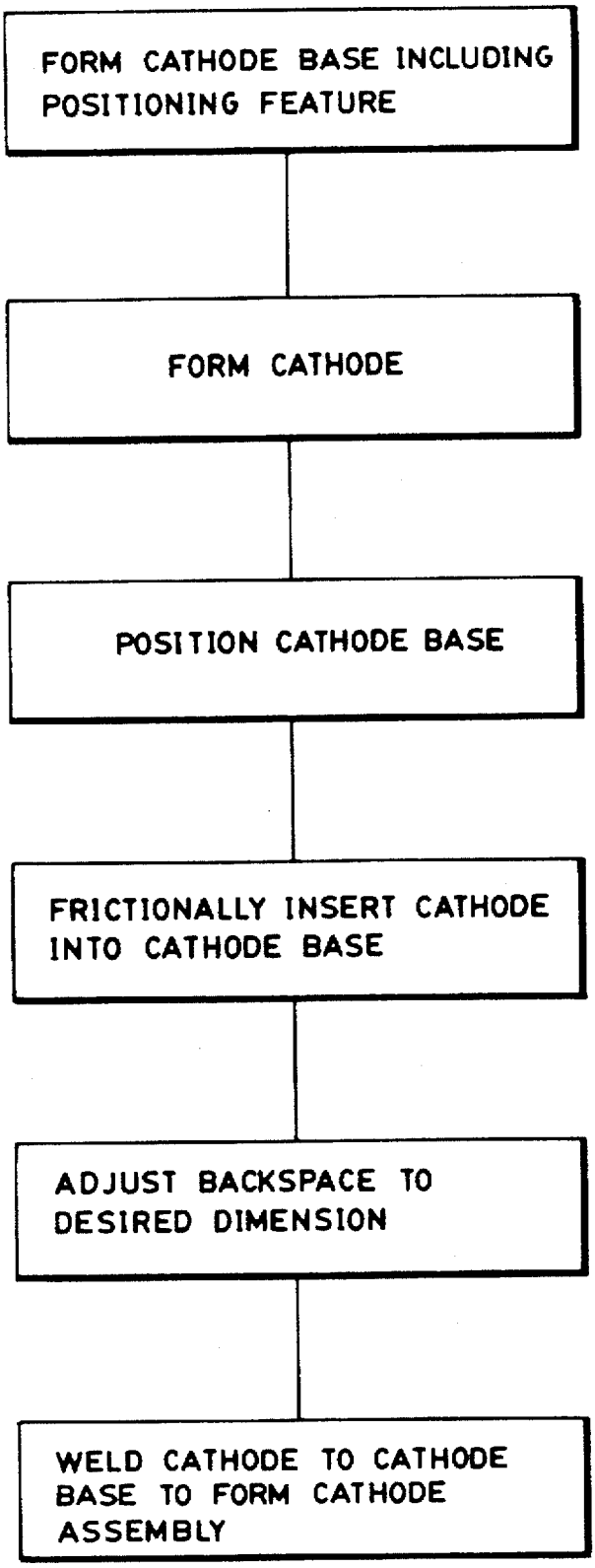
FIG. 9 is a flow diagram of a method of making the cathodes of the invention.

Referring now to FIGS. 7 and 8, it will be seen how identical components of base 24 and electrode 18 can form electrode assembly **16*a* having a backspace "A" and electrode assembly 16*b*** having a backspace "B", considerably larger than "A", providing a much smaller arc gap when used in the same length arc tube.

Thus, it will be seen that many advantages are provided over the prior art. The backspace can be easily controlled by adjusting how far the tungsten rod 20 is inserted into the electrode base 24. The region on base 24 that provides the frictional engagement with rod 20 is designed, by virtue of its thicker wall, so that it does not melt during TIG welding, thereby ensuring that no relative movement between the rod 20 and the electrode base 24 will occur. This electrode base design significantly reduces the amount of electrode base material that needs to be melted to form the hermetic joint between the base 24 and the rod 20, thereby permitting shorter welding times and increasing productivity.

No backspace positioning feature has to be made on the electrode base during the electrode assembly process since the positioning feature 38 is fabricated before the electrode assembly operation. Historically, backspace setting has been the rate limiting step in electrode assembly manufacturing.

The ring 40 formed on the electrode base 24 does not effect the tube strength for the joining operation or the arc tube mounting in a completed lamp and the electrode assembly 16 is compatible with existing arc tube sealing processes and materials.

The crimping operation previously employed with a straight tubular design, such as that shown in U.S. Pat. No. 5,343,117, is eliminated.

The fixed external length of the electrode base 24 eases the design and operation of automatic mounting systems and the utilization of a single tungsten rod length for all lamp types which may employ different backspaces reduces material stocks and eliminates material mix.

While there have been shown an described what are at present considered the preferred embodiments of the invention, it will be apparent to those skilled in the art that various changes and modifications can be made herein without departing from the scope of the invention as defined by the appended claims.

What is claimed is:

1. An electrode base for an electrode for an arc discharge lamp, said electrode base comprising: a tubular, electrically conductive body having a first end having a first diameter and a second end having second and third diameters, said second and third diameters being smaller than said first diameter and said second diameter being smaller than said third diameter; and a positioning ring formed about an intermediate portion of said first end.

2. The electrode base of claim 1 wherein said first end has a given wall thickness and said second end has a transverse portion having a wall thickness about twice said given wall thickness.

3. An electrode assembly comprising: an electrode having a rod-shaped, solid core of an electrically conductive material having a coil of electrically conductive material wrapped about one end thereof; and an electrode base in accordance with claim 2; said rod-shaped core having a diameter substantially equal to said second diameter and being frictionally engaged within said second end of said base.

4. An arc discharge light source comprising: an elongated, translucent, hermetically sealed ceramic body containing an arc generating and sustaining medium therewithin; a sealing member closing each end of said body; and an electrode assembly fitted into each of said ends, said electrode assembly being formed in accordance with claim 3.

* * * * *